US007252754B2

(12) United States Patent
DeHaan et al.

(10) Patent No.: US 7,252,754 B2
(45) Date of Patent: Aug. 7, 2007

(54) PRODUCTION OF BIODEGRADABLE MIDDLE DISTILLATES

(75) Inventors: Robert DeHaan, Sasolburg (ZA); Luis Pablo Dancuart, Sasolburg (ZA); Mark Jan Prins, Sasolburg (ZA); Ewald Watermeyer DeWet, Vanderbijlpark (ZA)

(73) Assignee: Sasol Technology (Pty) Ltd., Johannesburg (ZA)

( * ) Notice: Subject to any disclaimer, the term of this patent is extended or adjusted under 35 U.S.C. 154(b) by 219 days.

(21) Appl. No.: 10/808,940

(22) Filed: Mar. 24, 2004

(65) Prior Publication Data

US 2004/0173502 A1 Sep. 9, 2004

Related U.S. Application Data

(62) Division of application No. 09/787,641, filed as application No. PCT/ZA99/00094 on Sep. 17, 1999, now abandoned.

(30) Foreign Application Priority Data

Oct. 5, 1998 (ZA) ..... 98/9037

(51) Int. Cl.
*C10L 1/04* (2006.01)

(52) U.S. Cl. ..... 208/15; 585/734

(58) Field of Classification Search ..... 208/15; 585/734

See application file for complete search history.

(56) References Cited

U.S. PATENT DOCUMENTS 5,635,457 A 6/1997 Van Slyke
5,689,031 A * 11/1997 Berlowitz et al. ..... 585/734
6,296,757 B1 * 10/2001 Wittenbrink et al. ..... 208/15

FOREIGN PATENT DOCUMENTS

WO 92/14804 9/1992
WO 97/14769 4/1997

* cited by examiner

*Primary Examiner*—Glenn Caldarola
*Assistant Examiner*—Prem C. Singh
(74) *Attorney, Agent, or Firm*—Merchant & Gould P.C.

(57) ABSTRACT

This invention relates to a process for production of middle distillates having biodegradability properties. More particularly, this invention relates to a process for production of middle distillates produced from a mainly paraffinic synthetic crude which is produced by the reaction of CO and $H_2$, typically by the Fischer-Tropsch (FT) process. The middle distillate produced according to the process of the invention may be a diesel fuel, having an aromatics content of less than 9%, as determined by the ASTM D 5186 or IP 391 test method. The paraffinic chains of the middle distillate may be predominantly isoparaffins.

14 Claims, 3 Drawing Sheets

PRODUCTION OF BIODEGRADABLE MIDDLE DISTILLATES

This application is a divisional of application Ser. No. 09/787,641, filed Jun. 8, 2001 now abandoned, which is a National Stage Application of PCT/ZA99/00094, filed Sep. 17, 1999, which applications are incorporated herein by reference.

FIELD OF THE INVENTION

This invention relates to middle distillates having biodegradability properties and to a process for production of such distillates. More particularly, this invention relates to middle distillates produced from a mainly paraffinic synthetic crude which is produced by the reaction of CO and $H_2$, typically by the Fischer-Tropsch (FT) process.

BACKGROUND TO THE INVENTION

In recent years a trend has developed to produce products which are so called "environmentally friendly", one aspect of which is biodegradability. To this end various bodies, such as ISO and the OECD have developed test methods to quantify biodegradability. One such test is the $CO_2$ evolution test method, also known as the modified Sturm OECD method 301B, which test for ready biodegradability. In terms of this test, compounds can be considered to be readily biodegradable if they reach 60% biodegradation within 28 days.

Currently available middle distillates, typically crude oil derived diesel fuels, such as US 2-D grade (low sulphur No. 2-D grade for diesel fuel oil as specified in ASTM D 975-94) and/or CARB (California Air Resources Board 1993 specification) grade diesel, do not meet the biodegradability requirements of the abovementioned biodegradability test.

The prior art teaches in ZA 96/9890 that high biodegradability of hydrocarbon base oils could be derived from the presence of predominantly mono-methyl branching on the paraffinic carbon backbone. U.S. Pat. No. 5,498,596 discloses a non-toxic, biodegradable well fluid comprising 98% (mass) n-paraffins and less than 1% (mass) monocyclic aromatics as well as other olefinic components. The biodegradability of the well fluid in the US patent can not be related back to the nature of the paraffinic molecules due to the fact that biodegradability is enhanced through branching and not through linear n-paraffinic molecules. Further, WO 92/14804 discloses a low aromatic diesel fuel which comprises mainly a mixture of hydrocarbons containing not more than 1% by volume of aromatic type hydrocarbons and less than 0.05% sulfur or sulfur compounds. The fuel is disclosed as reducing unwanted emissions and improving operational performance. The disclosure however does not address the issue of biodegradeability. Still further, WO 97/14769 discloses diesel fuels having excellent lubricity, oxidative stability and high cetane number produced from the non-shifting Fischer-Tropsch process. Again no mention is made regarding biodegradability and the disclosure of oxidative stability would indicate against biodegradability.

A need thus exists for a middle distillate cut, typically a diesel fuel, which is readily biodegradable as determined by the abovementioned biodegradability test.

Surprisingly, it has now been found, that a low aromatics content and a relatively high iso-paraffins to n-paraffins ratio contribute to ready biodegradability of middle distillates, such as diesel fuel.

SUMMARY OF THE INVENTION

Thus, according to a first aspect of this invention, there is provided a biodegradable middle distillate cut, such as a diesel fuel, having an aromatics content of less than 9 mass %, as determined by the ASTM D 5186 or IP 391 test method.

The synthetic middle distillate cut may have less than 8.99 mass % monocyclic aromatics content.

The synthetic middle distillate cut may have less than 0.01 mass % polycyclic aromatics.

The synthetic middle distillate cut may have an isoparaffins to n-paraffins mass ratio of between about 1:1 to about 12:1, typically the isoparaffins to n-paraffins mass ratio is between about 2:1 to about 6:1, and in one embodiment is 4:1.

The synthetic middle distillate cut may be a FT process product, or be at least partially produced in accordance with the FT process and/or process philosophy.

According to a second aspect of the invention, the synthetic middle distillate cut includes more than 50 mass % isoparaffins, wherein the isoparaffins consist predominantly of methyl and/or ethyl and/or propyl branched isoparaffins.

The gradient of an isoparaffins to n-paraffins mass ratio profile of the synthetic middle distillate cut may increase from about 1:1 for $C_8$ to 8.54:1 for $C_{15}$ and decrease again to about 3:1 for $C_{18}$.

Typically, a fraction of the synthetic middle distillate cut in the $C_{10}$ to $C_{18}$ carbon number range has a higher ratio of isoparaffins to n-paraffins than a $C_8$ to $C_9$ fraction of the synthetic middle distillate cut.

The isoparaffins to n-paraffins mass ratio of the $C_{10}$ to $C_{18}$ fraction may be between 1:1 and 9:1.

The isoparaffins to n-paraffins mass ratio may be 8.54:1 for a $C_{15}$ fraction of the synthetic middle distillate cut.

A $C_{19}$ to $C_{24}$ fraction of the middle distillate cut may have a narrow mass ratio range of isoparaffins to n-paraffins of between 3.3:1 and 5:1, generally between 4:1 and 4.9:1.

The mass ratio of isoparaffins to n-paraffins may be adjusted by controlling the blend ratio of hydrocracked to straight run components of the synthetic middle distillate cut. Thus, the isoparaffins to n-paraffins mass ratio of the $C_{10}$ to $C_{18}$ fraction having 30% straight run component may be between 1:1 and 2:5:1.

The isoparaffins to n-paraffins mass ratio of the $C_{10}$ to $C_{18}$ fraction having 20 mass % straight run component may be between 1.5:1 and 3:5:1.

The isoparaffins to n-paraffins mass ratio of the $C_{10}$ to $C_{18}$ fraction having 10 mass % straight run component may be between 2.3:1 and 4.3:1.

The isoparaffins to n-paraffins mass ratio of the $C_{10}$ to $C_{18}$ fraction having substantially only a hydrocracked component may be between 4:1 and 9:1

At least some of the isoparaffins of the middle distillate cut may be methyl branched.

Typically, wherein at least some of the isoparaffins are di-methyl branched.

In a useful embodiment, at least 30 mass % of the isoparaffins are mono-methyl branched.

Some of the isoparaffins may be ethyl branched, or even propyl branched.

TABLE A

Comparison of the Branching Characteristics of Blends of SR, HX and SPD Diesels

| | SR Diesel | | | HX Diesel | | | SPD-Diesel | | |
|---|---|---|---|---|---|---|---|---|---|
| | n-Paraff | I-Paraff | Total | n-Paraff | I-Paraff | Total | n-Paraff | I-Paraff | Total |
| C8 | 1.07 | | 1.07 | 0.38 | | 0.38 | 0.58 | | 0.58 |
| C9 | 22.64 | 1.57 | 24.21 | 1.86 | 5.37 | 7.23 | 6.01 | 3.60 | 9.61 |
| C10 | 14.73 | 1.74 | 16.47 | 1.90 | 8.43 | 10.33 | 6.48 | 6.12 | 12.60 |
| C11 | 5.43 | 0.32 | 5.75 | 1.60 | 8.75 | 10.35 | 6.13 | 6.31 | 12.44 |
| C12 | 11.79 | 0.67 | 12.46 | 1.41 | 8.88 | 10.29 | 6.57 | 5.94 | 12.51 |
| C13 | 11.16 | 0.65 | 11.81 | 1.32 | 8.46 | 9.78 | 6.31 | 6.03 | 12.34 |
| C14 | 11.66 | 0.70 | 12.36 | 1.27 | 8.95 | 10.22 | 6.41 | 5.82 | 12.23 |
| C15 | 9.19 | 0.46 | 9.65 | 1.03 | 8.80 | 9.83 | 4.98 | 4.97 | 9.95 |
| C16 | 4.94 | 0.31 | 5.25 | 0.96 | 6.38 | 7.34 | 2.58 | 3.53 | 6.11 |
| C17 | 0.88 | | 0.88 | 0.88 | 3.92 | 4.80 | 0.76 | 2.33 | 3.09 |
| C18 | 0.08 | | 0.08 | 0.90 | 2.73 | 3.63 | 0.66 | 1.93 | 2.59 |
| C19 | | | | 0.60 | 2.69 | 3.29 | 0.38 | 1.47 | 1.85 |
| C20 | | | | 0.54 | 2.38 | 2.92 | 0.32 | 0.78 | 1.10 |
| C21 | | | | 0.56 | 2.73 | 3.29 | 0.29 | 0.72 | 1.01 |
| C22 | | | | 0.60 | 2.12 | 2.72 | 0.29 | 0.53 | 0.82 |
| C23 | | | | 0.41 | 1.93 | 2.34 | 0.25 | 0.40 | 0.65 |
| C24 | | | | 0.23 | 0.92 | 1.15 | 0.16 | 0.38 | 0.54 |
| C25 | | | | | 0.14 | 0.14 | | | |
| Total | 93.57 | 6.42 | 99.99 | 16.45 | 83.58 | 100.03 | 49.16 | 50.86 | 100.02 |

In the table:
SPD—Sasol Slurry Phase Distillate
SR—Straight Run
HX—Hydrocracked

TABLE B

Branching Characteristics of Blends of SR & HX Diesels

| | iso:normal Paraffins Ratio (mass) | | | |
|---|---|---|---|---|
| SR Diesel (mass) | 0% | 10% | 20% | 30% |
| C8 | 0.0 | 0.0 | 0.0 | 0.0 |
| C9 | 2.9 | 1.3 | 0.8 | 0.5 |
| C10 | 4.4 | 2.4 | 1.6 | 1.1 |
| C11 | 5.5 | 4.0 | 3.0 | 2.3 |
| C12 | 6.3 | 3.3 | 2.1 | 1.4 |
| C13 | 6.4 | 3.3 | 2.1 | 1.4 |
| C14 | 7.0 | 3.5 | 2.2 | 1.5 |
| C15 | 8.5 | 4.3 | 2.7 | 1.8 |
| C16 | 6.6 | 4.3 | 2.9 | 2.1 |
| C17 | 4.5 | 4.0 | 3.6 | 3.1 |
| C18 | 3.0 | 3.0 | 3.0 | 2.9 |
| C19 | 4.5 | 4.5 | 4.5 | 4.5 |
| C20 | 4.4 | 4.4 | 4.4 | 4.4 |
| C21 | 4.9 | 4.9 | 4.9 | 4.9 |
| C22 | 3.5 | 3.5 | 3.5 | 3.5 |
| C23 | 4.7 | 4.7 | 4.7 | 4.7 |
| C24 | 4.0 | 4.0 | 4.0 | 4.0 |
| C25 | | | | |

Branching Characteristics of FT Diesel versus iso:normal paraffins mass ratio are also described in FIG. 2.

According to a third aspect of the invention, there is provided a biodegradable synthetic middle distillate cut, having an aromatics content substantially as described above.

According to a fourth aspect of the invention, there is provided a biodegradable synthetic middle distillate cut, having an isoparaffinic content substantially as described above.

The invention extends to a biodegradable synthetic middle distillate cut, having an isoparaffinic content and an aromatics content substantially as described above.

The biodegradable synthetic distillate may be a FT product.

According to a fifth aspect of the invention, there is provided a biodegradable diesel fuel composition including from 10 mass % to 100 mass % of a middle distillate cut as described above.

The biodegradable diesel fuel composition may include from 0 to 90 mass % of another diesel fuel, such as conventional commercially available diesel fuel.

The biodegradable diesel fuel composition may include from 0 to 10 mass % additives.

The additives may include a lubricity improver.

The lubricity improver may comprise from 0 to 0.5 mass % of the composition, typically from 0.00001 mass % to 0.05 mass % of the composition. In a particularly useful embodiment, the lubricity improver comprises from 0.00 mass 8% to 0.02 mass % of the composition.

The biodegradable diesel fuel composition may include a crude oil derived diesel, such as US 2-D grade diesel fuel and/or CARB grade diesel fuel, as the other diesel fuel of the composition.

According to yet another aspect of the invention, there is provided a process for producing a readily biodegradable synthetic middle distillate, the process including:

(a) separating the products obtained from synthesis gas via the FT synthesis reaction into one or more heavier fraction and one or more lighter fraction;

(b) catalytically processing the heavier fraction under conditions which yield mainly middle distillates;

(c) separating the middle distillate product of step (b) from a light product fraction and a heavier product fraction which are also produced in step (b); and (d) blending the middle distillate fraction obtained in step (c) with at least a portion of the one or more lighter fraction of step (a), or products thereof.

The catalytic processing of step (b) may be a hydroprocessing step, for example, hydrocracking.

The process for producing a synthetic middle distillate may include one or more additional step of fractionating at least some of the one or more lighter fraction of step (a), or products thereof, prior to step (d).

The process for producing a synthetic middle distillate may include the additional step of hydrotreating at least some of the one or more light fraction of step (a), or products thereof, prior to step (d).

The one or more heavier fraction of step (a) may have a boiling point above about 270° C., however, it may be above 300° C.

The one or more lighter fraction may have a boiling point in the range $C_5$ to the boiling point of the heavier fraction, typically in the range 160° C. to 270° C.

The product of step (d) may boil in the range 100° C. to 400° C. The product of step (d) may boil in the range 160° C. to 370° C.

The product of step (d) may be obtained by mixing the middle distillate fraction obtained in step (c) with at least a portion of the one or more lighter fraction of step (a), or products thereof, in a volume ratio of between 1:1 and 9:1, typically 2:1 and 6:1, and in one embodiment, in a volume ratio of 84:16.

The product of the above process may be a synthetic middle distillate cut, or products thereof, or compositions thereof, as described above.

The product of step (d) may be a diesel fuel.

A biodegradable diesel fuel produced in accordance with this invention may be produced from a mainly paraffinic synthetic crude (syncrude) obtained from synthesis gas (syngas) through a reaction like the FT reaction.

The FT products cover a broad range of hydrocarbons from methane to species with molecular masses above 1400; including mainly paraffinic hydrocarbons and much smaller quantities of other species such as olefins and oxygenates. Such a diesel fuel could be used on its own or in blends to improve the quality of other diesel fuels not meeting the current and/or proposed, more stringent fuel quality and environmental specifications.

The invention extends to an essentially non-polluting, readily biodegradable diesel fuel composition comprising of a mixture of normal paraffins (n-paraffins) and iso-paraffins in the typical diesel range from 160-370° C., having an iso-paraffin:n-paraffin mass ratio from about 2:1 to about 12:1, more typically from 2:1 to 6:1, and the iso-paraffins of the mixture contain greater than 30 mass %, based on the total mass of the iso-paraffins in the mixture, of mono-methyl species, with the balance consisting mainly of ethyl and/or dimethyl branched species. These iso-paraffins contained in a mixture with minor amounts of aromatics and other materials, contribute to a product from which readily biodegradable diesel fuels can be obtained.

This diesel will readily biodegrade in an aquatic environment under aerobic conditions. This biodegradability can be attributed to the very low aromatic content present in the middle distillate cut, typically a diesel fuel. The aromatic content will typically comprise 2.5% (mass) of monocyclic, 0.2% (mass) of dicyclic and <10 ppm (mass) of polycyclic aromatics with a total aromatic content of around 2.7% (mass).

SPECIFIC DESCRIPTION OF THE INVENTION

Process

Figure 1:
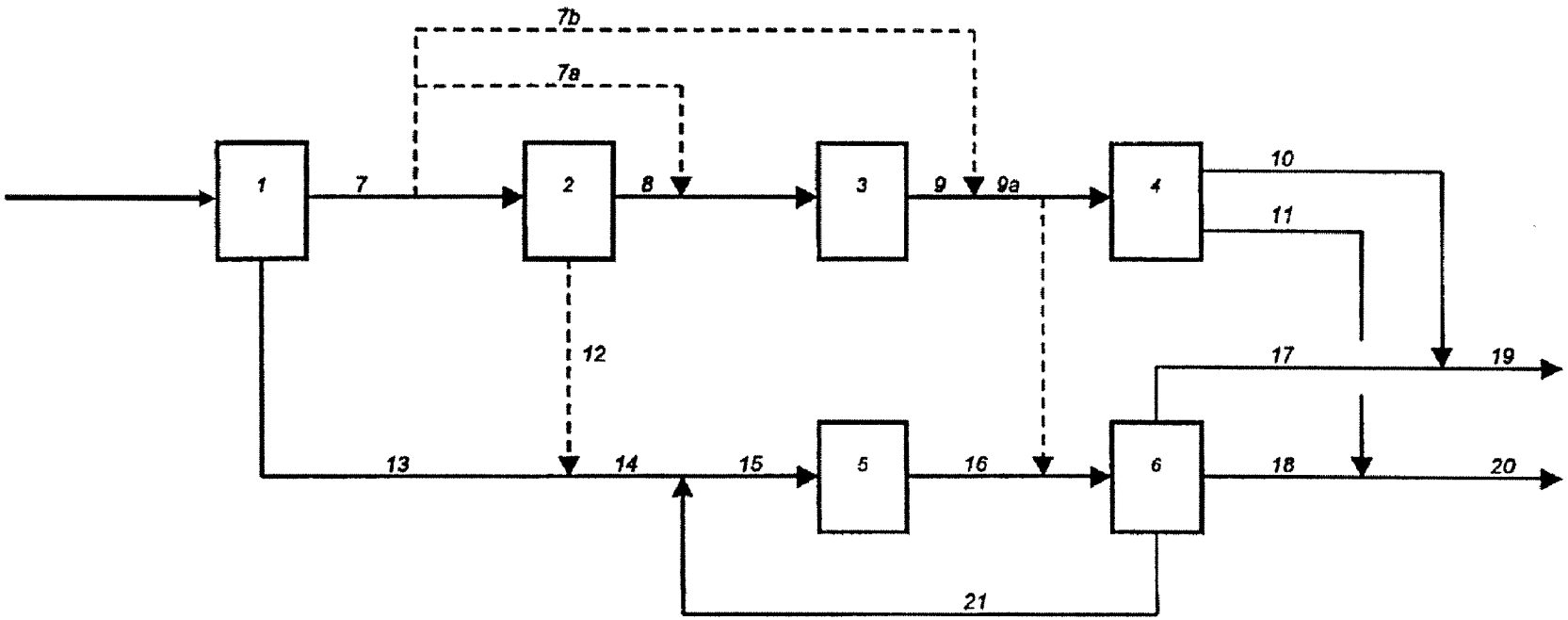
FIG. 1 is a schematic representation.
Figure 2:
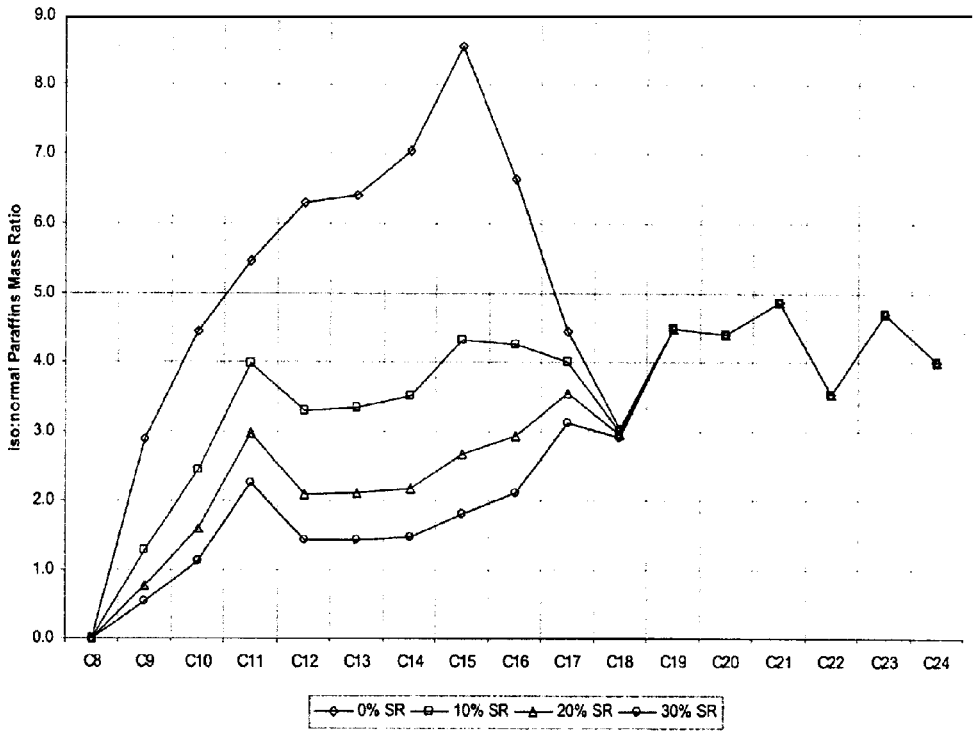
FIG. 2 is a graphical representation of branching characteristics of FT Diesel.
Figure 3:
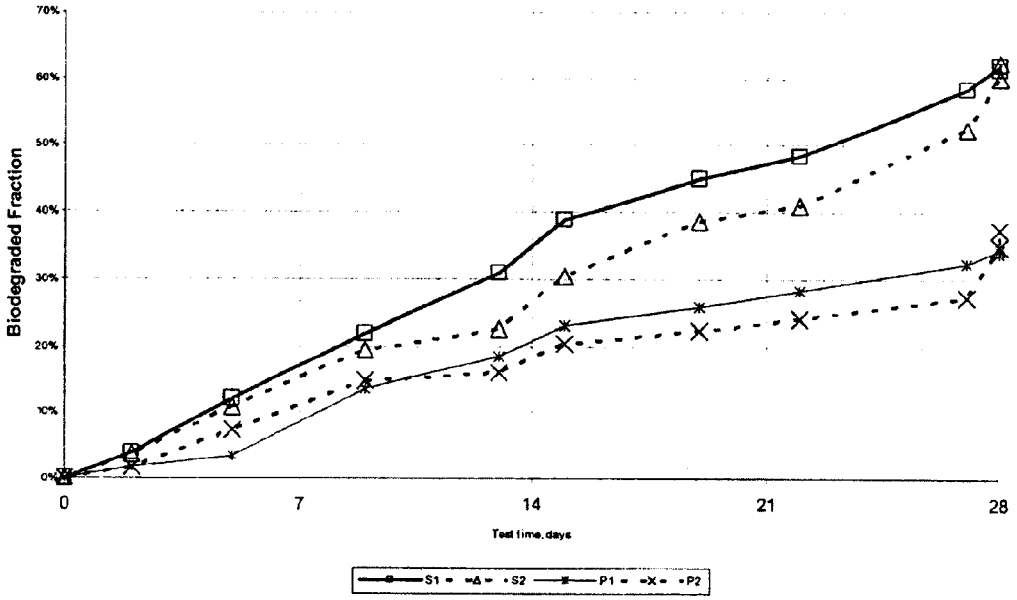
FIG. 3 is a graphical representation of biodegration over time entitled "Chart 1: Biodegradability Test Results (Modified Sturm Test)."

The process of this invention provides a process for the conversion of primary FT products into naphtha and middle distillates, specifically high performance diesel.

The FT process is used industrially to convert synthesis gas, derived from coal, natural gas, biomass or heavy oil streams, into hydrocarbons ranging from methane to species with molecular masses above 1400. While the main products are linear paraffinic materials, other species such as branched paraffins, olefins and oxygenated components form part of the product slate. The exact product slate depends on reactor configuration, operating conditions and type of catalyst that is employed, as is evident from e.g. Catal. Rev.-Sci. Eng., 23(1&2), 265-278 (1981).

Typical reactors for the production of heavier hydrocarbons (i.e. waxy hydrocarbons) are the Slurry Bed or the Tubular Fixed Bed types, while typical operating conditions are 160-280° C., in some cases 210-260° C., and 18-50 Bar, in some cases 20-30 Bar. Active metals typically useable in the catalyst used in such a reactor include iron, ruthenium or cobalt. While each catalyst will give its own unique product slate, in all cases the product contains some waxy, highly paraffinic material which needs to be further upgraded into usable products. The FT products can be converted into a range of final products, such as middle distillates, gasoline, solvents, lube oil bases, etc. Such conversion, which usually consists of a range of processes such as hydrocracking, hydrotreatment and distillation, can be termed a FT work-up process.

The FT work-up process of this invention uses a feed stream consisting of $C_5$ and higher hydrocarbons derived from a FT process. This feed is separated into at least two individual fractions, a heavier and at least one lighter fraction. The cut point between the two fractions is usually less than 300° C. and typically around 270° C.

The table below gives a typical composition of the two fractions, within about 10% accuracy:

TABLE 1

Typical Fischer-Tropsch product after separation into two fractions

| Boiling range | Condensate (<270° C., volume %) | Wax (>270° C., volume %) |
|---|---|---|
| $C_5$–160° C. | 45 | |
| 160–270° C. | 51 | 3 |
| 270–370° C. | 4 | 35 |
| 370–500° C. | | 42 |
| >500° C. | | 20 |

The >270° C. fraction, also referred to as wax, contains a considerable amount of hydrocarbon material, which boils higher than the normal diesel range. If we consider a diesel boiling range of 100-400° C., typically 160-370° C., it means that all material heavier than about 370° C. needs to be converted into lighter materials by means of a catalytic process often referred to as hydrocracking. Catalysts for this step are of the bifunctional type; i.e. they contain sites active for cracking and for hydrogenation. Catalytic metals active for hydrogenation include group VIII noble metals, such as platinum or palladium, or sulphided Group VIII base metals, e.g. nickel, cobalt, which may or may not include a sulphided Group VI metal, e.g. molybdenum. The support for the metals can be any refractory oxide, such as silica, alumina, titania, zirconia, vanadia and other Group III, IV, VA and VI oxides, alone or in combination with other refractory oxides. Alternatively, the support can partly or totally consist of zeolite. Amorphous silica-alumina is the preferred support for middle distillates conversion.

Process conditions for hydrocracking can be varied over a wide range and are usually laboriously chosen after extensive experimentation to optimise the yield of middle distillates. In this regard, it is important to note that, as in many chemical reactions, there is a trade-off between conversion and selectivity. A very high conversion will result in a high yield of gases and low yield of distillate fuels. It is therefore important to painstakingly tune the process conditions in order to limit the conversion of >370° C. hydrocarbons. Table 2 lists some of the conditions found, after extensive experimentation, to provide a desirable product range.

TABLE 2

Typical Hydrocracking Process Conditions

| Process Condition | Broad Range | Preferred Range |
|---|---|---|
| Temperature, ° C. | 150–450 | 340–400 |
| Pressure, bar(g) | 10–200 | 30–80 |
| Hydrogen Flow Rate, $m^3_n/m^3$ feed | 100–2000 | 800–1600 |
| Conversion of >370° C. material, Mass % | 30–80 | 50–70 |

It will be clear to those skilled in the art that it is possible to convert all the >370° C. material in the feedstock by recycling the part that is not converted during the hydrocracking process.

As is evident from table 1, most of the fraction boiling below 270° C. is already boiling in the typical boiling range for diesel, i.e. 160-370° C. This fraction may or may not be subjected to hydrotreating. By hydrotreating, heteroatoms are removed and unsaturated compounds are hydrogenated. Hydrotreating is a well-known industrial process catalysed by any catalyst having a hydrogenation function, e.g. Group VIII noble metal or a sulphided base metal or sulphided Group VI metals, or combinations thereof. Preferred supports are alumina and silica. Table 3 lists typical operating conditions for the hydrotreating process.

TABLE 3

Typical Hydrotreating Process Conditions

| Process Condition | Broad Range | Preferred Range |
|---|---|---|
| Temperature, ° C. | 150–450 | 200–400 |
| Pressure, bar(g) | 10–200 | 30–80 |
| Hydrogen Flow Rate, $m^3_n/m^3$ feed | 100–2000 | 400–1600 |

While the hydrotreated fraction may be fractionated into paraffinic materials useful as solvents, the applicant has now found that the hydrotreated fraction may be directly blended with the products obtained from hydrocracking the wax. Although it is possible to hydroisomerise the material contained in the condensate stream, the applicant has found that this leads to a small, but significant loss of material in the diesel boiling range to lighter material. Furthermore, isomerisation leads to the formation of branched isomers, which leads to Cetane ratings less than that of the corresponding normal paraffins (n-paraffins).

Several diesel fuels, produced broadly in accordance with the invention, as well as other crude oil derived diesel fuels such as US 2-D grade and CARB grade, were tested by the applicant. The basic characteristics of the fuels tested for biodegradability are included in Table 4(a).

Synthetic diesel fuels, produced broadly in accordance with this invention, and other conventional diesels were tested by the applicant. It was found that there were significant differences regarding the chemical composition of the fuels.

In particular, the synthetic fuels contained very small quantities of aromatic species. Other differences relate to the predominance of paraffinic species in the synthetic diesels, as can be seen from Table 4(b).

Upon analysis, it thus appears, since most of the other characteristics of the synthetic and conventional diesel fuels are not very dissimilar, the difference in the biodegradability performance can be attributed to the differences in the chemical nature indicated above.

TABLE 4(a)

Basic Characteristics of the Tested Fuels

| Fuel Name | | SPD Diesel Type A | SPD Diesel Type B | Commercial US 2D | CARB* Protocol Standard |
|---|---|---|---|---|---|
| Fuel Code | | S1 | S2 | P1 | P2 |
| Density (15° C.) | $Kg/dm^3$ | 0.7769 | 0.7779 | 0.8547 | 0.8308 |
| Distillation | ASTM D86 | | | | |
| IBP | ° C. | 189 | 185 | 184 | 203 |
| 10% | ° C. | 209 | 208 | 214 | 218 |
| 50% | ° C. | 256 | 257 | 259 | 249 |
| 90% | ° C. | 331 | 332 | 312 | 290 |
| FBP | ° C. | 356 | 358 | 342 | 351 |
| HPLC Aromatics (mass %) | Modified IP 391 Method | 0.47% | 0.35% | 32.78% | 6.65% |
| Monocyclic | Mass % of HPLC Aromatics | 93.62% | N/A | 71.35% | 99.55% |
| Bicyclic | Mass % of HPLC Aromatics | 6.38% | N/A | 25.84% | 0.45% |

TABLE 4(a)-continued

Basic Characteristics of the Tested Fuels

| Fuel Name | | SPD Diesel Type A | SPD Diesel Type B | Commercial US 2D | CARB* Protocol Standard |
|---|---|---|---|---|---|
| Polycyclic | Mass % of HPLC Aromatics | <0.01% | N/A | 2.81% | <0.01% |
| Oxygen | (mass %) | N/D | 0.3% | N/D | N/D |
| Sulphur (mass %) | ASTM D4294 | 0.001% | 0.002% | 0.022% | 0.028% |

*CARB—California Air Resources Board

Furthermore, in a specific middle distillate produced in accordance with this invention, the total amount of isoparaffins in the light boiling range of the diesel (160-270° C. fraction) and the heavier range of the diesel (270° C.-370° C.) are shown in the following Table 4(b).

TABLE 4(b)

Isoparaffins:n-Paraffins of Middle Distillate Fractions

| Boiling Range | Corresponding Carbon Range | Average Iso:Normal Paraffins Ratio Range | Average Iso:Normal Paraffins Ratio Typical value |
|---|---|---|---|
| 160–270° C. | $C_{10}$–$C_{17}$ | 0.5–4.0 | 2.2 |
| 270–370° C. | $C_{17}$–$C_{23}$ | 4.0–14.0 | 10.5 |

It is this unique composition of the synthetic fuel, which is directly caused by the way in which the FT work-up process of this invention is operated, that contributes to the unique characteristics of said middle distillates.

The applicant has also found, that from the perspective of fuel quality, it is not necessary to hydrotreat the <270° C. fraction, adding said fraction directly to the products from hydrocracking the wax. While this results in the inclusion of oxygenates and unsaturates in the final diesel, fuel specifications usually allow for this. Circumventing the need for hydrotreatment of the condensate results in considerable savings of both capital and operating cost.

The invention will now be illustrated, by way of non-limiting examples only, with reference to the accompanying FIG. 1.

A FT work-up process is outlined in the attached FIG. 1. The synthesis gas (syngas), a mixture of Hydrogen and Carbon Monoxide, enters the FT reactor 1 where the synthesis gas is converted to hydrocarbons by the FT process.

A lighter FT fraction is recovered in line 7, and may or may not pass through fractionator 2 and hydrotreater 3. The product 9 (9*a*) from the hydrotreater may be separated in fractionator 4 or, alternatively, mixed with hydrocracker 5 products 16 and sent to a common fractionator 6.

A waxy FT fraction is recovered in line 13 and sent to hydrocracker 5. If fractionation 2 is considered then the bottoms cut 12 are also sent to hydrocracker 5. The products 16, on their own or mixed with the lighter fraction 9*a*, are separated in fractionator 6.

Depending on the process scheme, a light product fraction, naphtha 19, is obtained from fractionator 6 or by blending equivalent fractions 10 and 17. This is a $C_5$-160° C. fraction useful as naphtha.

A somewhat heavier cut i.e. the middle cut, synthetic diesel 20, is obtainable in a similar way from fractionator 6 or by blending equivalent fractions 11 and 18. This cut is recovered as a 160-370° C. fraction useful as diesel The heavy unconverted material 21 from fractionator 6 is recycled to extinction to hydrocracker 5. Alternatively, the residue may be used for production of synthetic lube oil bases. A small amount of $C_1$-$C_4$ gases is also separated in fractionator 6.

The described FT work-up process of FIG. 1 may be combined in a number of configurations. The applicant considers these an exercise in what is known in the art as Process Synthesis Optimisation.

However, the specific process conditions for the Work-up of Fischer-Tropsch primary products, the possible process configurations of which are outlined in Table 5, were obtained after extensive and laborious experimentation and design.

TABLE 5

Possible Fischer-Tropsch Product Work-up Process Configurations

| Process Step | | Process Configuration A | B | C | D | E | F |
|---|---|---|---|---|---|---|---|
| 2 | Light FT Product Fractionator | | | X | | | X |
| 3 | Light FT Product Hydrotreater | X | X | | | X | X |
| 4 | Hydrotreater Products Fractionator | | X | | | X | X |
| 5 | Waxy FT Product Hydrocracker | X | X | X | X | X | X |
| 6 | Hydrocracked Products Fractionator | X | X | X | X | X | X |

Number Reference numerals of Figure 1
FT Fischer-Tropsch

Experimental Procedure

The biodegradability of the fuels was tested using the Carbon Dioxide Evolution method (modified Sturm OECD Method 301B). This method tests for ready biodegradability. A compound can be considered readily biodegradable if it reaches 60% biodegradation within 28 days under the prescribed test conditions. Domestic activated sludge, not previously exposed to industrial effluent, was used as the source of micro-organisms for the test. The biodegradability tests were continuously validated using Sodium acetate as a reference chemical for checking the viability of the micro-organisms.

The test involves aerating the sample by passing carbon dioxide-free air at a controlled rate in the dark or in diffuse light. The sample must be the only source of carbon. Degradation is followed over 28 days by determining the carbon dioxide produced. This gas is trapped in barium or sodium hydroxide, and it is measured by titration of the residual hydroxide or as inorganic carbon. For additional details refer to the standard procedure.

The results of the tests are set out in table 6 and chart 1 below.

TABLE 6

Biodegradability of Diesel Fuels (Modified Sturm Test)

| Days | Synthetic Diesels | | Petroleum Diesels | |
|---|---|---|---|---|
| from start of test sequence | SPD A S1 | SPD B S2 | US 2D P1 | CARB P2 |
| 0 | 0% | 0% | 0% | 0% |
| 2 | 4% | 4% | 2% | 2% |
| 5 | 12% | 11% | 4% | 7% |
| 9 | 22% | 19% | 14% | 15% |
| 13 | 31% | 23% | 18% | 16% |
| 15 | 39% | 30% | 23% | 20% |
| 19 | 45% | 39% | 26% | 22% |
| 22 | 48% | 41% | 28% | 24% |
| 27 | 58% | 53% | 32% | 27% |
| 28 | 62% | 60% | 34% | 35% |
| 28 | 61% | 63% | 34% | 37% |

EXAMPLES

Example 1

Fuel S1 was produced broadly in accordance with the invention, by following the process described above. It is a fully hydroprocessed fuel. The fractionation of the two basic components was completed in separate steps. S1 diesel was a blend of 84% (vol) of hydrocracked diesel (product stream 11 from fractionator 4) and 16% (vol) of hydrotreated diesel (product stream 18 from fractionator 6) produced using configuration B of Table 5. It contained 2.68% total aromatics, most of the aromatics species being monocyclic.

This fuel biodegraded 61% after 28 days under the conditions specified for the described modified Sturm OECD Method 301 B. A fuel with this behavior is considered biodegradable.

Example 2

Fuel S2 was produced by hydrocracking of the FT wax and distilling the diesel fraction (product stream 18). The primary light FT products were distilled separately (product stream 11 produced without passing through hydrotreater 3). S2 diesel was obtained by blending these two cuts in a 84:16 ratio (volume). Process Configuration C of Table 5 was used to produce this fuel. The total aromatics content was 2.46%.

This fuel biodegraded 63% after 28 days under the same conditions described in example 1. This fuel can also be considered biodegradable.

Example 3

Fuel P1 is a commercial diesel procured in the United States of America. It meets the US 2D diesel specification. This conventional petroleum based diesel fuel contained 38.22% aromatics, almost 71% of which were monocyclic species.

This fuel biodegraded 34% under the conditions described in example 1. A fuel with this behavior is not considered biodegradable.

Example 4

Fuel P2 is a non-commercial fuel procured in the United States of America. It meets the specifications of the California Air Resources Board (CARB) protocol. This fuel contained 9.91% aromatics, mainly monocyclic species. In spite of this, this fuel biodegraded only ca 37% under the conditions described in example 1.

A fuel with this behavior is not considered biodegradable.

The invention claimed is:

1. A process for producing a readily biodegradable synthetic middle distillate, the process including:

(a) separating the products obtained from synthesis gas via the FT synthesis reaction into one or more heavier fraction and one lighter fraction, wherein the one or more heavier fraction of step (a) boils above about 270° C., and wherein the lighter fraction boils in the range $C_5$ to the boiling point of the heavier fraction, and the lighter fraction is separately hydrotreated prior to step (d);

(b) catalytically processing the one or more heavier fraction under conditions which yield mainly middle distillates;

(c) separating the middle distillate product of step (b) from the lighter product and heavier product that are also produced in step (b); and (d) blending the middle distillate fraction obtained in step (c) with at least a portion of the lighter fraction of step (a), or products thereof wherein at least 60% of the synthetic middle distillate is biodegraded within 28 days as measured by the Carbon Dioxide Evolution method.

2. A process for producing a synthetic middle distillate as claimed in claim 1, wherein the catalytic processing of step (b) is a hydroprocessing step.

3. A process for producing a synthetic middle distillate as claimed in claim 1, wherein the catalytic processing of step (b) is a hydrocracking step.

4. A process for producing a synthetic middle distillate as claimed in claim 1, including one or more additional step of fractionating the lighter fraction of step (a), or products thereof, prior to step (d).

5. A process for producing a synthetic middle distillate as claimed in claim 1, wherein the one or more heavier fraction of step (a) boils above about 300° C.

6. A process for producing a synthetic middle distillate as claimed in claim 1, wherein the lighter fraction boils in the range 160° C. to 270° C.

7. A process for producing a synthetic middle distillate as claimed in claim 1, wherein the product of step (d) boils in the range 100° C. to 400° C.

8. A process for producing a synthetic middle distillate as claimed in claim 1, wherein the product of step (d) boils in the range 160° C. to 370° C.

9. A process for producing a synthetic middle distillate as claimed in claim 1, wherein the product of step (d) is a diesel fuel.

10. A process for producing a synthetic middle distillate as claimed in claim 8, wherein the product of step (d) is a diesel fuel.

11. A process for producing a synthetic middle distillate as claimed in claim 1, wherein the product of step (d) is obtained by mixing the middle distillate fraction obtained in step (c) with at least a portion of the lighter fraction of step (a), or products thereof, in a volume ratio selected to provide a diesel fuel having a required specification.

12. A process for producing a synthetic middle distillate as claimed in claim 11, wherein the product of step (d) is obtained by mixing the middle distillate fraction obtained in step (c) with at least a portion of the lighter fraction of step (a), or products thereof, in a volume ratio of between 1:1 and 9:1.

13. A process for producing a synthetic middle distillate as claimed in claim 12, wherein the product of step (d) is obtained by mixing the middle distillate fraction obtained in step (c) with at least a portion of the lighter fraction of step (a), or products thereof, in a volume ratio of between 2:1 and 6:1.

14. A process for producing a synthetic middle distillate as claimed in claim 13, wherein the product of step (d) is obtained by mixing the middle distillate fraction obtained in step (c) with at least a portion of the lighter fraction of step (a), or products thereof, in a volume ratio of 84:16.

* * * * *